United States Patent [19]

Kane et al.

[11] Patent Number: 5,074,117

[45] Date of Patent: Dec. 24, 1991

[54] AIR HANDLING SYSTEM

[75] Inventors: David M. Kane, Darien; William E. Fry, Stamford, both of Conn.

[73] Assignee: Mistop, Inc., East Norwalk, Conn.

[21] Appl. No.: 610,431

[22] Filed: Nov. 7, 1990

[51] Int. Cl.[5] ..... F25D 21/14

[52] U.S. Cl. ..... 62/93; 62/281; 55/269

[58] Field of Search ..... 62/93, 281, 283; 55/269

[56] References Cited

U.S. PATENT DOCUMENTS

| | | | |
|---|---|---|---|
| 1,847,609 | 3/1932 | Harnett | 55/269 |
| 2,187,470 | 1/1940 | Collins | 62/93 X |
| 2,301,529 | 11/1942 | Fagan | 55/269 |
| 2,517,537 | 8/1950 | Andregg | 62/93 X |
| 2,588,339 | 3/1952 | Anderegg | 62/93 X |
| 3,304,696 | 2/1967 | McKenna | 62/93 X |
| 3,359,753 | 12/1967 | Fiedler et al. | 62/93 X |
| 3,396,515 | 8/1968 | Wright | 55/269 |
| 3,593,500 | 7/1971 | Ritland et al. | 55/269 X |
| 3,678,661 | 7/1972 | Davis | 55/269 |
| 3,851,822 | 12/1974 | Pocrnja et al. | 62/93 X |
| 4,513,577 | 4/1985 | Wilson et al. | 62/281 X |

*Primary Examiner*—William E. Tapolcai

*Attorney, Agent, or Firm*—St. Onge, Steward, Johnston & Reens

[57] ABSTRACT

The invention provided relates to a process and system for treating the air in a building involving providing a series of air passages through the building; generating a flow of air through said series of air passages; cooling said air flow by means of at least one cooling coil; and reducing the moisture level of said cooled air flow by passing said cooled air flow through a mesh pad.

21 Claims, 2 Drawing Sheets

AIR HANDLING SYSTEM

TECHNICAL FIELD

The present invention relates to an air handling system and process which is capable of circulating air through a building for ventilation, cooling, or dehumidification purposes. This system generally comprises a series of air passages disposed throughout a building through which is generated a flow of air, at least one cooling coil across which the air flow is conducted, and means for reducing the moisture level of the cooled air comprising a mesh pad.

Many conventional ventilation, air conditioning (i.e., cooling), and dehumidification systems are described in the American Society of Heating Refrigeration and Air Conditioning Engineers ("ASHRAE") 1989 Fundamentals Handbook ("ASHRAE Handbook"). Such systems generally include appropriate air passages, at least one fan, and cooling coil(s). In addition, such systems may also include other desired elements such as filters, air mixers, dampers, modulating devices, and other control and/or monitoring components to direct and otherwise control the flow of air through the passages.

Commonly, the air which is being cooled or dehumidified is "moist air" which is generally defined as a binary mixture of dry air and water vapor, the maximum presence of which (referred to as "saturation") is a state of neutral equilibrium between water vapor and condensed water phase which depends to a great extent on temperature and pressure (ASHRAE Handbook, Chapter 6). In such systems it is desired that water vapor contained in the moist air be condensed on the cooling coil surfaces and drained away to as great an extent as possible. Failure to do so may result in water droplets being entrained in the air flowing through the system and condensing or otherwise being deposited in areas where the water can cause damage due to corrosion, staining, spoilage, or other moisture related problems.

In order to avoid these water problems, it is generally believed that a nominal air flow velocity across the cooling coil of 500 feet per minute (fpm) or less is needed. Such low air flow velocities are often disadvantageous, though, because they can increase the system size depending on the amount of air flow needed to ventilate, cool, dehumidify, etc. the building in which the system is operating. Greatly increased system size is often impractical due to lack of adequate space, as well as economic considerations.

Accordingly, it is desirable to operate air handling systems at as high an air flow velocity as possible to minimize size, and usually above 500 fpm. Generally, the air flow velocity for most applications will be between about 500 and about 800 fpm. Since such high velocities often cause moisture carry-over (entrainment) in the air flow, a device for eliminating moisture from the air flow after it has passed over a cooling coil must be incorporated in a commercially practical air handling system.

Presently, moisture elimination devices generally utilize chevron-style moisture eliminators which rely on the impingement of entrained water droplets on the eliminator surfaces. The droplets then run down the chevron blades, and are collected or drained in suitable apparatus.

These chevron moisture eliminators are generally "three-bend" or "six-bend" type eliminators, and are usually mounted up to six feet from the cooling coil. In most commercial installations, chevron moisture eliminators must be at least 6 inches deep for adequate reduction of entrained water. Typical chevron moisture eliminators and mounting brackets therefor are illustrated in FIGS. 3 and 4. Unfortunately, chevron-type moisture eliminators are difficult and costly to manufacture and install; they lead to a relatively high pressure drop through the system, which is directly translatable to high energy use, and thus high operating cost; and they require substantial space, which can often not be accommodated, especially in the case of retrofit installations in an existing system where no additional space is available.

What is desired, therefore, is an air handling system which is effective at ventilation, cooling, or dehumidification, yet which is able to eliminate substantial amounts of carry-over moisture from the air flow in a practical and efficient manner.

DESCRIPTION OF INVENTION

The present invention relates to a process and system for handling the ventilation, cooling, or dehumidification of the air in a building, which comprises providing a series of air passages through the building; generating a flow of air through the air passages; cooling the air flow by means of a cooling coil; and reducing the moisture level of the cooled air by passing the cooled air flow through a mesh pad.

DESCRIPTION O THE DRAWINGS

The invention will be better understood and its advantages will become more apparent from the following detailed description, especially when read in light of the attached drawings, wherein:

FIG. 1 is an isometric view of a knitted, mesh pad moisture eliminator useful in the claimed invention.

FIG. 1*a*. is a cross-sectional view of the moisture eliminator of FIG. 1, taken along lines A—A;

DETAILED DESCRIPTION OF THE PREFERRED EMBODIMENT

Figure 1:
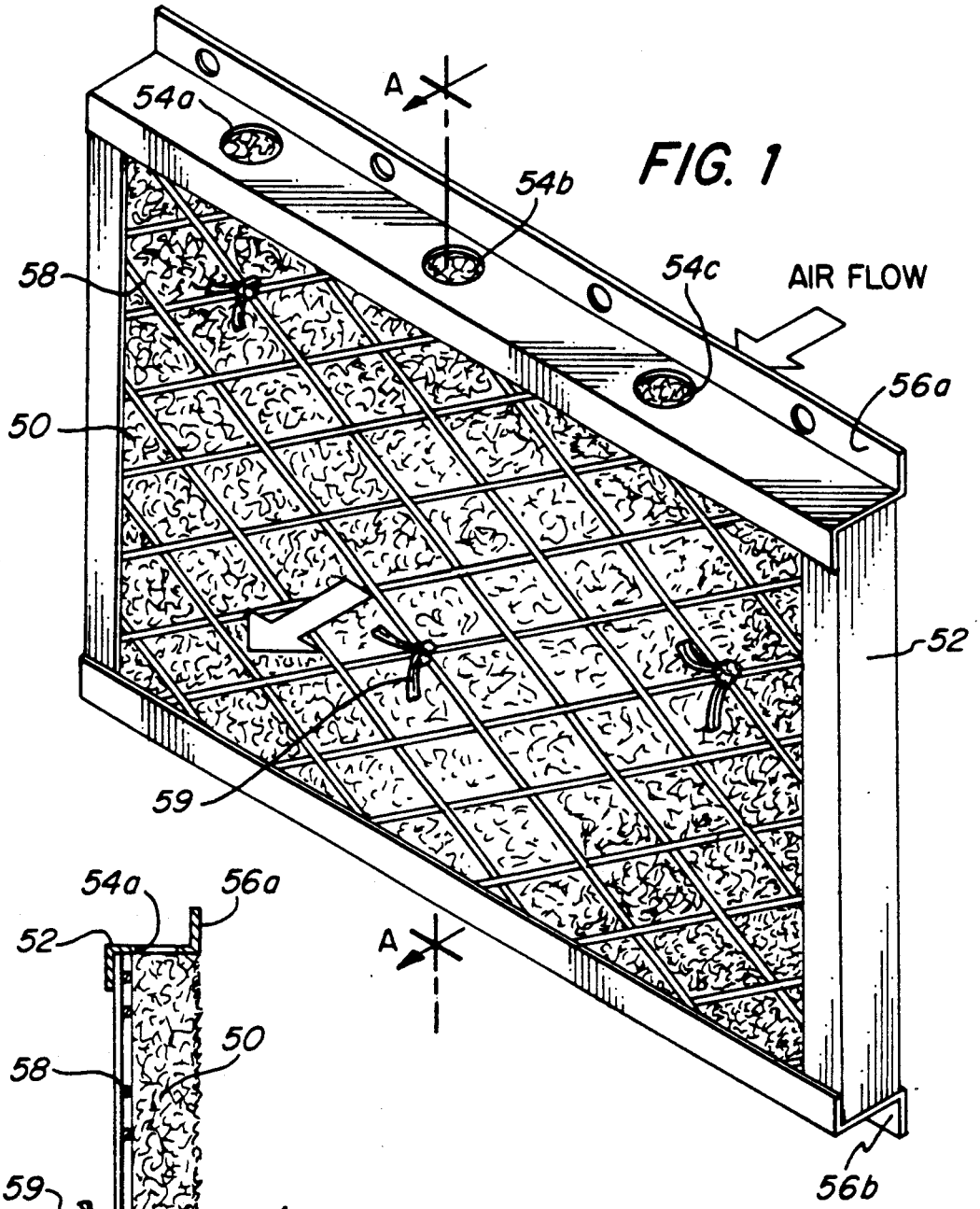

Referring to the drawings, an air handling system in accordance with the invention is generally indicated by the reference numeral 10. It should be noted that for the sake of clarity all the components and parts of air handling system 10 are not shown and/or marked in all the drawings. In addition, the terms "top" and "bottom" refer to the orientation illustrated in FIG. 1. It will be understood, though, that the illustrated orientation is not necessary for operability of air handling system 10.

The present invention relates to a process for the ventilation, cooling, or dehumidification of the air in a building, as well as an air handling system 10 for effecting the process. This process generally comprises providing a series of air passages throughout a building, generating a flow of air through these passages, conducting the air flow across at least one cooling coil, and reducing the moisture level of the cooled air by passing it through a knitted, mesh pad.

The buildings in which the process and system of the present invention may be utilized include office buildings, apartment buildings, health care facilities such as hospitals and nursing homes, hotels or motels, educational institutions such as schools and universities, as well as private residences. In addition, the inventive process and system can be used in factories, manufacturing facilities, or other business establishments such as research and development facilities, and are effective wherever air cooling, ventilation, or dehumidification is desired without moisture in the air. For instance, in manufacturing plants for computer chips, excess moisture can be extremely disadvantageous as it can compromise computer chip purity or quality.

Generally, the air passages 20 provided according to the process of the invention comprise the heating/ventilation/air conditioning ducts or passages throughout the building, although other suitable air conduits throughout the building may be utilized. Air passages 20 generally run from a central area (usually located either on the roof or in the basement of the building), where many of the other elements of the system are disposed, through the internal spaces of the building with vents or other output elements 22 disposed in rooms or areas for which ventilation, cooling, dehumidification, etc., is desired. In addition, air passages 20 often have associated therewith intake or other input means 24 exposed to the outside environment in order to draw air into system 10 and output means 26 in order to expel air from system 10.

The present invention further involves generating a flow of air through the series of air passages 20. This is accomplished through at least one flow means which is suitable for causing an air flow of the desired velocity (preferably above 500 fpm, more preferably about 500 fpm to about 800 fpm, as noted). This air flow generating means generally comprises a fan 30 having sufficient power to cause the desired flow of air through system 10. Although only one fan 30 is needed, it is also possible to dispose more than one fan throughout system 10 in order to maintain a steady and consistent flow of air. Suitable fans for use in system 10 of the present invention would be familiar to the skilled artisan and are conventional in the art.

The process of the present invention also involves cooling the air flow generated by fan 30 by a cooling means comprised of at least one cooling coil 40. Cooling coil 40 generally comprises a conduit through which a cooling medium flows. In order to cool the air with as much efficiency as possible, it is preferred to pass the air flow across cooling coil 40 in a manner intended to contact as much surface area of cooling coil 40 with the air flow as possible. To do so, cooling coil 40 can advantageously be configured as rows of tubes which are staggered or disposed in line with respect to the air flow. In a preferred embodiment, the individual tube passes of cooling coil 40 are interconnected by return bends to form a serpentine arrangement, as would be familiar to the skilled worker in the field. In addition, cooling coil 40 can be formed as a plurality of cooling coils arranged in combination or in series.

Cooling coil 40 can be of the bare tube or finned tube type through which water, ethylene glycol, propylene glycol, or brine solutions of calcium chloride or sodium chloride are circulated as the cooling medium. In addition, cooling coil 40 can be of the bare tube or finned tube type through which a refrigerant is circulated as the cooling medium. Typical refrigerants include ammonia, fluorocarbons, and chlorofluorocarbons. In addition, much effort is underway to replace chlorofluorocarbons with more environmentally benign compositions, and they would also be useful in cooling coil 40 used in the present invention.

Cooling coil 40 can be formed from any suitable water resistant material, including copper, brass, aluminum, and stainless steel, although copper and brass are preferred due to their strength and resistance to corrosion. Depending on the application, cooling coil 40 can be of various sizes based upon the cubic feet of air flowing across cooling coil 40 per minute. It is not unusual for cooling coil 40 to be up to 20 feet wide or more, and at least 12 feet high. Generally, such cooling coils would be made up of smaller sized sections 40*a*, 40*b*, 40*c*, etc., which are stacked or otherwise combined to provide the desired size for cooling coil 40. In most applications, cooling coil 40 can vary between about 0.5 feet wide to about 50 feet wide, and about 0.5 feet high to about 50 feet high. Preferably, cooling coil 40 is between about 4 and about 40 feet wide and about 2 and about 20 feet high. As noted, cooling coil 40 can be comprised of a single, unitary cooling coil or a series of cooling coil sections.

Cooling coil 40 generally has associated therewith at least one draining pan 42 through which water which condenses on cooling coil 40 is collected and channeled into suitable storage or disposal means. The temperature of cooling coil 40 should be less than that of the air flow across it, due to the cooling medium flowing through cooling coil 40, and moisture in the air will tend to condense on cooling coil 40 and flow down to drain pan 42. Although much of the moisture in the air can be eliminated this way, excess moisture remains entrained in the air flow after passing across cooling coil 40 due at least in part to the velocity considerations noted above.

The process of the present invention further comprises reducing the moisture level of the cooled air by passing the cooled air flow through an elimination means comprising a mesh pad 50 which is disposed up to about six feet downstream from cooling coil 40 for greatest efficiency. As its name implies, mesh pad 50 comprises a mass of fibrous strands bunched together in a bundled mass, and is usually prepared by "knitting" of the component fibers. Because of its nature, "knitted", mesh pad 50 serves to eliminate a substantial portion of the entrained water remaining in the air flow. Although not wishing to be bound by any theory, it is believed that mesh pad 50 captures water vapor or droplets in the air flow by inertial impaction. Dry air passes through mesh pad 50 with relatively little resistance, but the density of mesh pad 50 is such that water vapor or droplets impact thereon and join with others, which then run down to suitable collection or drain means, as discussed in more detail below.

Figure 1A:
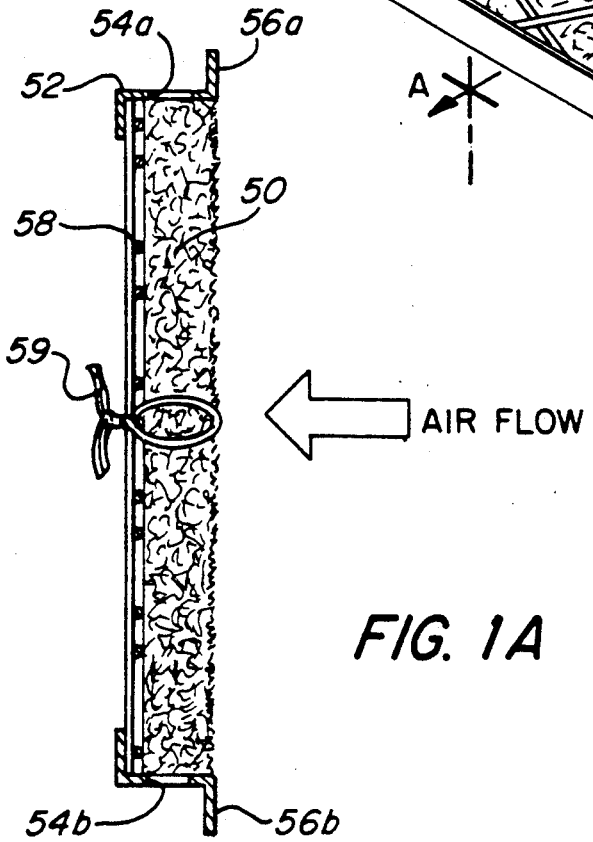
Figure 2:
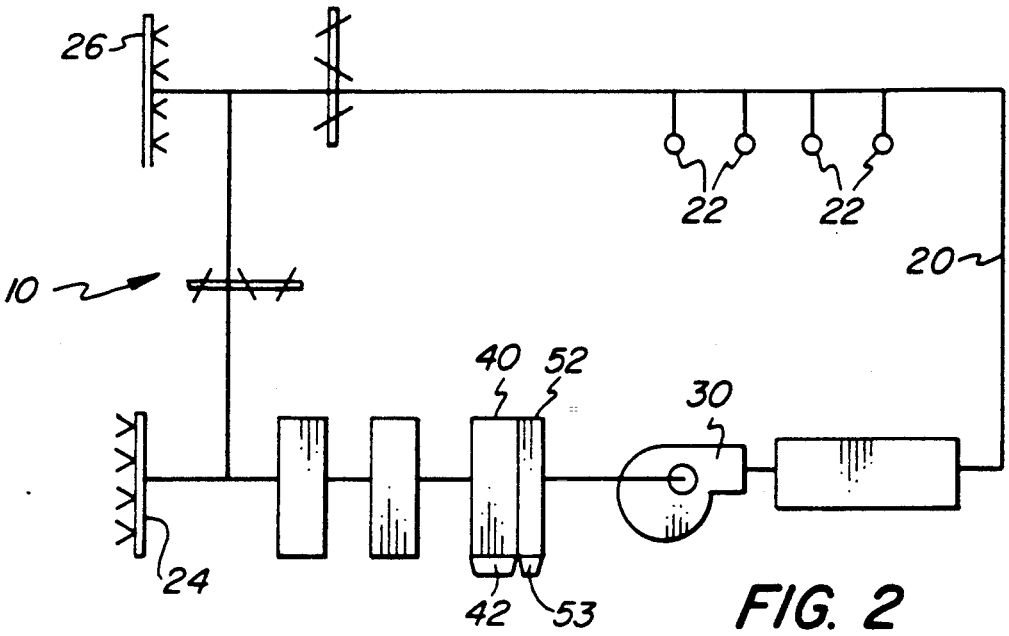
FIG. 2 is a schematic illustration of one embodiment of an air handling system useful in the claimed invention.
Figure 3:
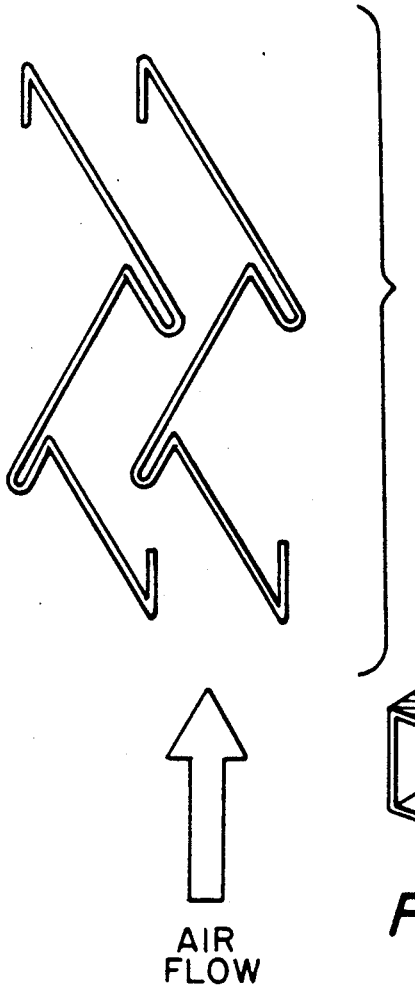
FIG. 3 is a partial top plan view of a chevron-type moisture eliminator.
Figure 4:
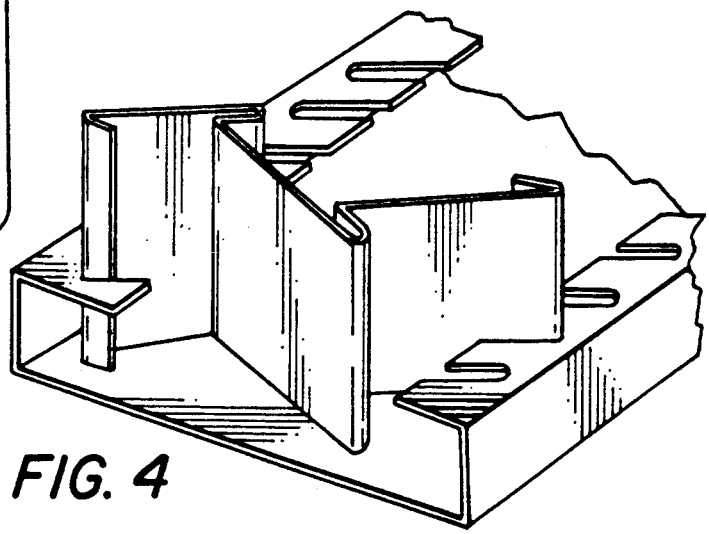
FIG. 4 is an isometric view of a chevron-type moisture eliminator mounted in a supporting bracket.

Generally, mesh pad 50 is contained within a frame 52 which can be attached to the discharge end of cooling coil 40 (which is usually situated within a suitable housing for containment and direction of the air flow across cooling coil 40) or, as noted, up to about six feet downstream thereof. Frame 52, as illustrated in FIGS. 1 and 1*a*, is a suitable retaining means for maintaining mesh pad 50 in position such that the air flow passes through mesh pad 50. Frame 52 is configured in the shape mesh pad 50 is to assume. Advantageously, frame 52 is rectangular in shape since the air flow being discharged from cooling coil 40 is usually generally rectangular due to the housing in which the air flows across cooling coil 40, which is most often rectangular in shape.

Frame 52 can also comprise holes or ports, 54*a*, 54*b*, 54*c*, 54*d*, etc. for draining of moisture eliminated from the air flow. When frame 52 is attached to the discharge end of cooling coil 40, moisture eliminated from the air flow by mesh pad 50 can drain through ports 54*a*, 54*b*, 54*c*, 54*d*, etc. to draining pan 42. Where frame 52 is mounted downstream from cooling coil 40, moisture can drain to an independent collection or drain means 53. Ports 54*a*, 54*b*, 54*c*, 54*d*, etc. are preferably disposed both at the top and at the bottom of frame 52 to allow an installer to install frame 52 without regard to orientation. Ports 54*a*, 54*b*, 54*c*, 54*d*, etc. can be any size or in any suitable number or pattern to adequately pass the moisture eliminated from the air flow to collection or drain means 53. In addition, frame 52 can also comprise attachment flanges 56*a* and 56*b*, which can be used to attach frame 52 (and, therefore, mesh pad 50) to the housing which contains cooling coil 40.

Advantageously, as illustrated in FIGS. 1 and 1*a*, frame 52 further comprises a grid or retaining means 58 which is disposed across the downstream side of frame 52 and mesh pad 50. Grid 58 serves to prevent mesh pad 50 from being forced out of frame 52 (and thereby out of optimal position) by the force of the air flow through mesh pad 50. Preferably, grid 58 and mesh pad 50 are attached through means such as ties 59 to assist in the maintenance of mesh pad 50 in position.

Frame 52 is preferably mounted to the housing in which cooling coil 40 is situated so as to maintain mesh pad 50 in a generally vertical orientation, since most applications involve passing an air flow which is in a generally horizontal orientation across cooling coil 40. A vertical orientation of mesh pad 50 has been found to be most efficient in these situations.

The size of mesh pad 50 and frame 52 will vary depending upon the air passage 20 in which it is being disposed, since it is desirable to have mesh pad 50 disposed across the entire passage 20 so that virtually all of the air flow passes through mesh pad 50. Where mesh pad 50 is mounted to the cooling coil 40 housing, mesh pad 50 should assume the dimensions of the housing, as described above. Accordingly, mesh pad 50 and frame 52 are preferably about 0.5 feet to about 50 feet in width, more preferably about 4 feet to about 40 feet, and about 0.5 feet to about 50 feet in width, more preferably about 2 feet to about 20 feet.

The depth and density of mesh pad 50 of the present invention can vary depending on the anticipated duty. Generally, the depth of mesh pad 50 will be between about 0.5 and about 6 inches, preferably between about 1 and about 3 inches, although greater depth can also be anticipated The density of mesh pad 50 is preferably about 3 pounds per cubic feet (lbs/ft$^3$) to about 12 lbs/ft$^3$, more preferably about 4 lbs/ft$^3$ to about 6 lb/ft$^3$. It will be recognized that as density increases, depth can decrease and as depth increases, density can decrease. These two factors can be adjusted to provide maximum efficiency with minimum space usage. Frame 52 should, but does not have to, have the same depth as mesh pad 50 for greatest stability.

Generally, mesh pad 50 can be formed of stainless steel, aluminum, copper, or non-metallic knitted meshes (such as fiberglass, polyethylene, etc.) of various gauges. Although any material which is relatively resistant to degradation or corrosion by extensive exposure to moisture can be utilized, it is advantageous to utilize a metal because it may be contrary to local fire protection codes to position a flammable material such as polyethylene in an air handling system. Typically, mesh gauges are about 0.003 inches to about 0.015 inches for mesh pad 50 of the present invention, more preferably about 0.010 inches to about 0.013 inches, although this can vary depending on the desired mesh density and depth.

Frame 52 in which mesh pad 50 is disposed can likewise be formed of any suitable material resistant to moisture, such as stainless steel, aluminum, galvanized steel, carbon steel, especially with corrosion preventing coatings, as well as non-metallic materials such as a high density plastic, with the required dimensional stability. Similarly, grid 58 disposed across frame 52 for retaining knitted, mesh pad 50 in place can also be stainless steel, aluminum, galvanized steel, or a non-metallic material having the required strength.

Since the air flow through mesh pad 50 is essentially straight, there is less resistance to air flow and thus, less pressure drop across mesh pad 50 of the present invention as compared with chevron-type moisture eliminators. In addition, the space required for installation of mesh pad 50 is less than that for chevron eliminators, 3- or 6-bend moisture eliminators which measure 3 inches and 12 inches, respectively. Moreover, installation is generally easier since it usually only requires attachment by screw or other type means of frame 52 containing mesh pad 50 to the housing in which cooling coil 40 is situated.

It will also be recognized that air handling system 10 can comprise other elements useful in providing ventilation, cooling, or dehumidification. Included among these are dampers, filters, intakes, and vents, and other control or modulating elements.

The above description is for the purpose of teaching the person of ordinary skill in the art how to practice the present invention, and it is not intended to detail all of those obvious modifications and variations of it which will become apparent to the skilled worker upon reading the description. It is intended, however, that all such obvious modifications and variations be included within the scope of the present invention which is defined by the following claims.

What is claimed is

1. An air handling system comprising:

a) a series of air passages disposed within a building;

b) flow means for generating a flow of air through said series of air passages;

c) cooling means disposed within said series of air passages so as to be contacted by the flow of air, said cooling means comprising at least one cooling coil; and d) elimination means disposed within said series of air passages so as to be contacted by the flow of air after said cooling means is contacted by the flow of air, said elimination means comprising a metallic mesh pad in order to reduce the moisture level of the flow of air.

2. The system of claim 1 wherein said series of air passages comprises the heating/ventilation/air conditioning ducts of a building.

3. The system of claim 2 wherein the building in which said ducts are disposed comprises a building selected from the group consisting of an office building, an apartment building, a health care facility, a hotel, an educational institution, manufacturing facility, research and development facility, and a private residence.

4. The system of claim 1 wherein said flow means comprises at least one fan apparatus.

5. The system of claim 4 wherein said at least one cooling coil comprises a conduit through which a cooling medium flows.

6. The system of claim 5 wherein said at least one cooling coil is configured in a serpentine arrangement.

7. The system of claim 5 wherein said cooling medium comprises a composition selected from the group consisting of water, ethylene glycol, propylene glycol, aqueous calcium chloride solutions, aqueous sodium chloride solutions, refrigerants, and mixtures thereof.

8. The system of claim 7 wherein said refrigerants comprise ammonia, fluorocarbons, chlorofluorocarbons, and mixtures thereof.

9. The system of claim 1 wherein said mesh pad comprises a material selected from the groups consisting of stainless steel, aluminum, copper, fiberglass, and combinations thereof.

10. The system of claim 9 wherein said mesh pad is retained within a frame composed of a material selected from the group consisting of stainless steel, galvanized steel, carbon steel, aluminum, a high density plastic material, and combinations thereof.

11. The system of claim 10 wherein said at least one cooling coil is disposed within a housing and said frame is removably attached to said housing.

12. A process for treating the air in a building comprising:

a) providing a series of air passages through the building;

b) generating a flow of air through said series of air passages;

c) cooling said air flow by means of at least one cooling coil; and d) reducing the moisture level of said cooled air flow by passing said cooled air flow through a metallic mesh pad.

13. The process of claim 12 wherein said series of air passages comprises the heating/ventilation/air conditioning ducts of a building.

14. The process of claim 13 wherein the building in which said ducts are disposed comprises a building selected from the group consisting of an office building, an apartment building, a health care facility, a hotel, an educational institution, manufacturing facility, research and development facility, and a private residence.

15. The process of claim 12 wherein said at least one cooling coil comprises a conduit through which a cooling medium flows.

16. The process of claim 15 wherein said at least one cooling coil is configured in a serpentine arrangement

17. The process of claim 15 wherein said cooling medium comprises a composition selected from the group consisting of water, ethylene glycol, propylene glycol, aqueous calcium chloride solutions, aqueous sodium chloride solutions, refrigerants, and mixtures thereof.

18. The process of claim 17 wherein said refrigerants comprise ammonia, fluorocarbons, chlorofluorocarbons, and mixtures thereof.

19. The process of claim 12 wherein said knitted, mesh pad comprises a material selected from the groups consisting of stainless steel, aluminum, copper, and combinations thereof.

20. The process of claim 19 wherein said mesh pad is retained within a frame composed of a material selected from the group consisting of stainless steel, galvanized steel, carbon steel, aluminum, a high density plastic material, and combinations thereof.

21. The process of claim 20 wherein said at least one cooling coil is disposed within a housing and said frame is removably attached to said housing.

* * * * *

UNITED STATES PATENT AND TRADEMARK OFFICE

CERTIFICATE OF CORRECTION

PATENT NO. : 5,074,117

DATED : December 24, 1991

INVENTOR(S) : David M. Kane, et al

It is certified that error appears in the above-identified patent and that said Letters Patent is hereby corrected as shown below:

On the cover sheet, at [56], please insert

OTHER PUBLICATIONS

1987 ASHRAE Handbook; Heating, Ventilation, and Air-Conditioning Systems and Applications; pp. 1.2-1.6, 2.1, 2.4-2.5, 2.13-2.14, 4.1-4.4, and 5.1-5.6;

1988 ASHRAE Handbook; Equipment; pp. 6.1-6.4;

1989 ASHRAE Handbook, Fundamental, I-P Edition, pp. 6.1, 6.16-6.17;

Koch Engineering Company, Inc., Bulletin, 1974;

Otto H. York Company, Inc., Bulletin 55A, 1988

Signed and Sealed this

Twenty-seventh Day of April, 1993

*Attest:*

*Attesting Officer*

MICHAEL K. KIRK

*Acting Commissioner of Patents and Trademarks*